US008931496B2

(12) United States Patent
Beyer et al.

(10) Patent No.: US 8,931,496 B2
(45) Date of Patent: Jan. 13, 2015

(54) COVERING SYSTEM

(71) Applicants: Andrea Elgin Beyer, Staten Island, NY (US); Steven Larsen Beyer, Staten Island, NY (US)

(72) Inventors: Andrea Elgin Beyer, Staten Island, NY (US); Steven Larsen Beyer, Staten Island, NY (US)

( * ) Notice: Subject to any disclaimer, the term of this patent is extended or adjusted under 35 U.S.C. 154(b) by 0 days.

(21) Appl. No.: 13/914,800

(22) Filed: Jun. 11, 2013

(65) Prior Publication Data

US 2014/0360541 A1 Dec. 11, 2014

(51) Int. Cl.
*A45B 25/02* (2006.01)
*A45B 19/12* (2006.01)
*A45B 25/18* (2006.01)

(52) U.S. Cl.
CPC ..... *A45B 25/02* (2013.01)
USPC ..... 135/15.1; 135/25.2; 135/33.2

(58) Field of Classification Search
CPC ..... A45B 19/12; A45B 23/00; A45B 25/24; A45B 25/18; A45B 2025/186
USPC ..... 135/15.1, 25.2, 34.2, 33.2, 33.5, 33.6
See application file for complete search history.

(56) References Cited

U.S. PATENT DOCUMENTS

| | | | | | |
|---|---|---|---|---|---|
| 1,255,182 | A * | 2/1918 | Krupski | 135/25.2 |
| 1,597,897 | A * | 8/1926 | Janowsky et al. | 135/25.2 |
| 1,699,717 | A * | 1/1929 | Rinne | 135/25.2 |
| 1,991,385 | A * | 2/1935 | Geisel | 135/25.2 |
| 2,164,242 | A * | 6/1939 | Henry | 135/34.2 |
| 2,215,738 | A * | 9/1940 | Kohler | 135/25.2 |
| 2,334,330 | A * | 11/1943 | Janowsky | 135/25.2 |
| 3,534,752 | A * | 10/1970 | Vanzini | 135/22 |
| 4,456,023 | A * | 6/1984 | Fujihashi | 135/25.41 |
| 4,978,110 | A * | 12/1990 | Lin et al. | 135/33.4 |
| 5,226,438 | A * | 7/1993 | Dubinsky | 135/33.4 |
| 5,368,055 | A * | 11/1994 | Johnson et al. | 135/33.7 |
| 5,487,401 | A * | 1/1996 | Johnson et al. | 135/33.7 |
| 5,601,103 | A * | 2/1997 | Dubinsky | 135/33.7 |
| 2004/0211451 | A1* | 10/2004 | Goh | 135/31 |
| 2006/0174926 | A1* | 8/2006 | McGuigan | 135/34.2 |

* cited by examiner

*Primary Examiner* — Noah Chandler Hawk

(57) ABSTRACT

A system is provided for protective elements that include, but is not limited to, an umbrella having a complete double canopy with pleats, a medially expanding frame, and a moisture mitigation vessel. The frame's linkage system and expanding double canopy enable their combined covering structure to take a downwardly concave form when fully deployed. Rounded outer frame edges provide enhanced safety. When retracted around the umbrella's stick, frame and canopy assume the form of a three dimensional envelope tapered up and down from its mid-section, thereby concentrated at top and bottom by the stick. This configuration provides canopy and frame with improved ability to move in and out of the invention's stick mounted moisture mitigation vessel. With an internal liner of wicking material and multiple surface apertures, the vessel encourages controlled release of evaporated moisture from the enclosed canopy.

5 Claims, 7 Drawing Sheets

COVERING SYSTEM

REFERENCES CITED

U.S. Patent Documents

U.S. Pat. No. 109,775 to Stephens, Nov. 29, 1870
U.S. Pat. No. 139,295, to Chevers, May 27, 1873
U.S. Pat. No. 212,457 to Girbardt, Feb. 18, 1879
U.S. Pat. No. 312,446 to Drake, February 1885
U.S. Pat. No. 892,813, to Dolles, Jul. 7, 1908
U.S. Pat. No. 1,088,743 to Swinland, March 1914
U.S. Pat. No. 1,217,515 to G. A. Simon, Feb. 27, 1917
U.S. Pat. No. 1,885,968, to Wedemann, Nov. 1, 1932
U.S. Pat. No. 2,164,242, to Henry, Aug. 6, 1938,
U.S. Pat. No. 2,164,242, to Henry, Jun. 27, 1939
U.S. Pat. No. 3,467,115 to Brooks, Sep. 16, 1969
U.S. Pat. No. 3,534,752, to Vanzini, Oct. 20, 1970
U.S. Pat. No. 4,456,023, to Fujihashi, Jun. 26, 1984
U.S. Pat. No. 4,934,394, to Hermanson, Jun. 19, 1990
U.S. Pat. No. 5,188,137, to Simonelli, Feb. 23, 1993
U.S. Pat. No. 5,226,438, to Dubinski, Jul. 13, 1993
U.S. Pat. No. 5,487,401, to Johnson et al., Jan. 30, 1996
U.S. Pat. No. 5,601,103, to Dubinsky, Feb. 11, 1997
U.S. Pat. No. 5,690,131, to Voigt, Nov. 25, 1997
U.S. Pat. No. 5,890,506, to Kuperman, Apr. 6, 1999
U.S. Pat. No. 6,006,770, to Lin, et al., Dec. 28, 1999
U.S. Pat. No. 6,273,111, to Weiss et al, Aug. 14, 2001
U.S. Pat. No. 6,345,637, to Ko, Feb. 12, 2002
U.S. Pat. No. 7,174,906, to Ko, Feb. 13, 2007
U.S. Pat. No. 6,701,947 B1, to Ramos, Mar. 9, 2004
U.S. Pat. No. 6,805,144, to Usui et al, Oct. 19, 2004,
U.S. Pat. No. 8,156,951, to Klose, Apr. 17, 2012
U.S. Pat. No. 8,225,806, to Simonelli, Jul. 24, 2012

TECHNICAL FIELD

The present invention generally relates to a structure having environmental protective elements, and more particularly relates to an umbrella frame and canopy system having improved efficiency, serviceability and capability of cooperating with elements of a dedicated moisture mitigation vessel.

BACKGROUND

Improvements to umbrella, canopy, and tent systems have evolved over the centuries and continue to refine useful aspects of their construction. Endeavors focused on varied components of such protective systems have resulted in significant advances. Benefits include, but are not limited to, improvements in the resilience and stability of umbrella frame elements, reduced size and compactness, enlarged canopy coverage, enhanced convenience of operation, and cost savings associated with evolved hardware as well as improvements in production methods.

A specific area of related interest with a lengthy history of teachings involves attempts at providing efficient cooperation between an umbrella frame and canopy with a dedicated protective container constructed as an integral part of the device.

Satisfactory containment of frame, canopy, and cooperating umbrella elements within such a structure would provide benefits including alleviation of adverse consequences from water transfer from a furled umbrella canopy onto adjacent environmental surfaces, thereby causing annoyance or potentially permanent damage. Such a containment system could also serve to protect the enclosed frame and canopy elements from potentially harmful external forces that could rip the canopy or bend the frame. A suitable vessel of containment would also eliminate the often frustrating need to secure a furled and wet frame and canopy with a belt style umbrella-tie or annular rib tip retainer.

Affording such benefits while additionally providing means for suitable dispersal of moisture from elements contained within the vessel, thereby also mitigating adverse consequences such as mold and mildew, are particular important benefits of the present embodiment of the invention taught and disclosed herein.

Furthermore, the present embodiment's system presents a visually satisfying entity that may additionally serve as vehicle for supporting graphics, written messages.

In addition, the present invention's complete double canopy provides supplementary surface area and internal volume between its upper and lower segments that may serve to contain additional enhancements, including an LED style illumination system. Previously efforts at teaching an invention capable of providing such a constellation of benefits have apparently met with limited success. Prior attempts to integrate an umbrella frame and canopy with a suitable dedicated container show little evidence of translation into practical solutions achieving wide distribution and marketplace success. This present invention teaches improvements providing solutions to issues that apparently caused the limited success of prior art.

Improvements and efficiencies taught in the present disclosure relate to practical well-ordered deployment and retraction of a frame and canopy system, its enhanced structural integrity, as well as convenient cooperation vis a vis a dedicated umbrella moisture mitigation vessel, thereby providing more than one of the previously enumerated improvements as well as other untallied or unexpected benefits.

RELATED ART

FOR EXAMPLE, U.S. Pat. No. 109,775 to Stephens, Nov. 29, 1870, teaches a method for sewing together equally sized triangular segments thereby forming the cover and lining of a parasol wherein stitching is not visible. This disclosure notes the invention is an improvement over prior art wherein stitches are visible and both cover and under liner of are both attached in close proximity to opposite sides, tops and bottoms, of stretchers and ribs. FIG. 6 of Stephens' disclosure shows a contemporary prior art example wherein a liner of equal size to the cover of a parasol or umbrella is attached across the underside of stretchers radially outward from runner to the junctions of ribs and stretchers. In that example the liner has substantial separation from the cover within this first zone. Stephens also indicates in FIG. 6 that the conventional liner shown in her example continues outward beyond said first zone and radially out across a second zone, wherein the liner is in close proximity with both ribs and cover, said second zone then terminating at conventional rib tips.

FOR EXAMPLE, U.S. Pat. No. 139, 295, to Chevers, May 27, 1873 teaches a combination umbrella and cane with hollow shaft, having detachable cap and ferrule to adapt the invention for alternate use as a cane. Canopy, ribs, and stretchers are stored within the hollow shaft during use as a cane. For use as an umbrella, stowed elements are removed from an opening at one end of the shaft and screwed onto the shaft's opposite end, thereby enabling the device's function as an umbrella. References are also seen to the appearance of unkempt, wet umbrella canopies furled outside folded umbrella frames. Concerns associated with the containment of umbrella canopies have long engaged inventors.

FOR EXAMPLE, U.S. Pat. No. 892,813, to Dolles, Jul. 7, 1908 teaches an umbrella whose canopy, ribs, stretchers, and stick, when collapsed, are capable of being retracted into a hollow shaft.

FOR EXAMPLE, U.S. Pat. No. 1,217,515 to G. A. Simon, Feb. 27, 1917 teaches an umbrella frame with lazy tong style linkage elements having unequal attachment lengths that assume a downwardly curved configuration when deployed. Said frame supports just a single top canopy and the invention also contains a telescoping stick. The umbrella frame terminates in a conventional set of elongated individual ribs. Each of these ribs terminating at a narrow tip. This invention's extended tip protrusions present an initially loose array when retracted unless frame elements are closely tethered to the stick. Unless said tips are gathered in some manner, their splayed grouping would present a relatively wide aspect to a narrow top opening of a stick mounted umbrella storage container. This configuration is significantly different from the presently taught embodiment wherein linkages comprise the medially expanding frame have distal termini comprising a pair of links not individual, conventional extended ribs as described by Simon.

FOR EXAMPLE, U.S. Pat. No. 1,885,968, to Wedemann, Nov. 1, 1932, describes an umbrella canopy somewhat similar to that of Dolles, with added provision for a telescoping stick and segmented, folding ribs.

FOR EXAMPLE, U.S. Pat. No. 2,164,242, to Henry, Jun. 27, 1939, teaches an umbrella comprised of a hollow shaft constructed and assembled to provide means for housing the umbrella canopy and frame in said shaft. Rather than enclosing conventionally downward folded umbrella rib and stretcher linkages within a hollow shaft, alternate solutions have been proposed involving upward folding. This teaching also raises questions about efficiency and neatness of fit between frame tips and the portal of a hollow shaft umbrella container. In this case rather loosely bound frame tips potentially may encounter engagements with elements of its storage container's upper opening, as the canopy and frame assembly is urged to exit the container. By contrast, the current embodiment of the present invention provides both the top and the bottom of its frame and canopy assembly retracted to sites having close proximity to the umbrella stick.

FOR EXAMPLE, U.S. Pat. No. 3,534,752, to Vanzini, Oct. 20, 1970, teaches internal storage of an umbrella canopy, as well as upwardly folded ribs and stretchers within a hollow umbrella shaft. Furthermore a method of twisting said elements during closing of the umbrella is described.

FOR EXAMPLE, U.S. Pat. No. 4,456,023 Jun. 26, 1984, to Fujihashi teaches a collapsible umbrella with water-tight sheathing handle. However, that handle shows no provision for rapid dispersal of moisture retained on umbrella elements stored within. This could lead to mold and mildew growth on contents. Problems with this teaching are not limited to that issue and also include apparent inability of the sliding member, stick, frame, and canopy assembly to resist potentially destructive torque that could bend or snap these elements away from the sheath handle when cooperating elements are not in a vertical orientation, this apparent flaw could be especially exacerbated during wind storms. This Fujihashi patent also provides an example of problems involved with bringing frame tips to sites sufficiently proximate to the umbrella stick in order to facilitate passage through the top opening of a sheathing handle during the retraction operation.

FOR EXAMPLE, U.S. Pat. No. 4,934,394 to Hermanson, Jun. 19, 1990 teaches an umbrella having multiple cords connecting frame tips to a slider mounted on a stick. When the umbrella is open the cords serve to place the canopy under tension and the canopy, cords, and part of the stick are said to form a stabilizing triangular structure when the canopy is open.

FOR EXAMPLE, U.S. Pat. No. 5,226,438, to Dubinski, Jul. 13, 1993, teaches lining material adapted for covering the underside of canopy cover ribs and frame support ribs, said lining material extending from a rib holder across stretcher ribs to canopy cover ribs, then outward to rib tips; this disclosure also teaches attachment means for attaching said lining material to said canopy cover ribs. It may be noted that this disclosure, as in the example of U.S. Pat. No. 109,775 referenced above, describes and illustrates an upper umbrella canopy and a lower liner; and said liner is situated adjacent to umbrella frame ribs in close proximity with the canopy across the span of a substantial zone extending from stretcher to rib junctions outward to rib tips. Therefore, there is no apparent possibility for triangular bracing of the frame by means of either cover or liner along the outer ring zone of proximity between canopy, liner, and rib. Such designs are commonly seen in the umbrella type reflectors used by photographers, wherein the liner forms a light concentrating surface. That configuration contrasts significantly with the presently taught embodiment comprising a complete double canopy with its upper and lower segments substantially separated from each other except at the singular location of their mutual distal periphery.

FOR EXAMPLE, U.S. Pat. No. 6,006,770 to Lin, et al., Dec. 28, 1999 teaches an umbrella having a lower canopy consisting of an annulus, supported by ribs. Said umbrella also having an upper canopy centrally mounted on a set of ribs, and canopying the central opening in the lower canopy.

FOR EXAMPLE, U.S. Pat. No. 6,273,111, to Weiss et al, Aug. 14, 2001, teaches a retractable umbrella including a canopy, a plurality of ribs, and a plurality of stretchers. Said canopy is supported at its center by an extended shaft and on its periphery by attachment to tips of said ribs. No additional canopy support is indicated. Said canopy and frame elements are contained within a hollow shaft when folded. Such unventilated umbrella container construction raises questions about mold and mildew formation.

FOR EXAMPLE, U.S. Pat. No. 6,698,440, to Beyer, et al, Mar. 2, 2004 teaches an umbrella with a chamber for storage of material such as an enclosure canopeum of netting.

FOR EXAMPLE, U.S. Pat. No. 6,701,947 B1, Mar. 9, 2004, to Ramos, who describes a flexible bag for containment of a wet umbrella, thereby additionally providing means for later disposal of water accumulated from said umbrella.

FOR EXAMPLE, U.S. Pat. No. 8,156,951, Apr. 17, 2012, to Klose teaches an umbrella container with air ducts and ventilation slits at its base. The disclosed permanently open slits indicate liquid water would be free to exit enclosed wet umbrella elements at potentially undesirable occasions such as when such an umbrella may being transported within a back pack or brief case or perhaps briefly placed on a table top susceptible to water damage.

A BRIEF SUMMARY

In accordance with the present embodiment of the invention, improvements for which patent protection is being sought include, but are not limited to, a complete double canopy with pleats sufficiently capacious so as to encompass and reinforce a medially expanding frame. These components are well suited for facilitating their mutual deployment and retraction relative to the embodiment's moisture mitigation vessel. The double ended shape of retracted canopy and frame elements, being closely attached respectively at top and bottom by the umbrella's stick, presents a gradually tapered profile when approaching the moisture mitigation vessel's opening, thereby expediting deployment and retraction operations. This vessel has the ability to contain a moisture exposed canopy as it encourages evaporative dispersal of such residual moisture. The invention's system also has applications to other covering devices such as garden type umbrellas, tents, and similar structures.

DETAILED DESCRIPTION

Introduction

Although the following description provides specific examples, these are not intended in any way to limit application and uses of the invention. There is no intention to be bound by any concept described in the preceding background, summary, or in what follows as the detailed description. It is understood that changes may be made in the way elements of the embodiments described herein operate, may be arranged, or may be applied without compromising the invention's scope as set forth in the appended claims and their legal equivalents.

The combination of improvements in the present embodiment of this invention is also applicable for use in other forms of umbrellas, tents, canopies, and analogous covering structures.

Although comprising conventional elements including attachment, securing, locking, and support means, the disclosed set of embodied elements comprises an assembly of elements not taught in the prior art of umbrella construction.

Deployment

Figure 1:
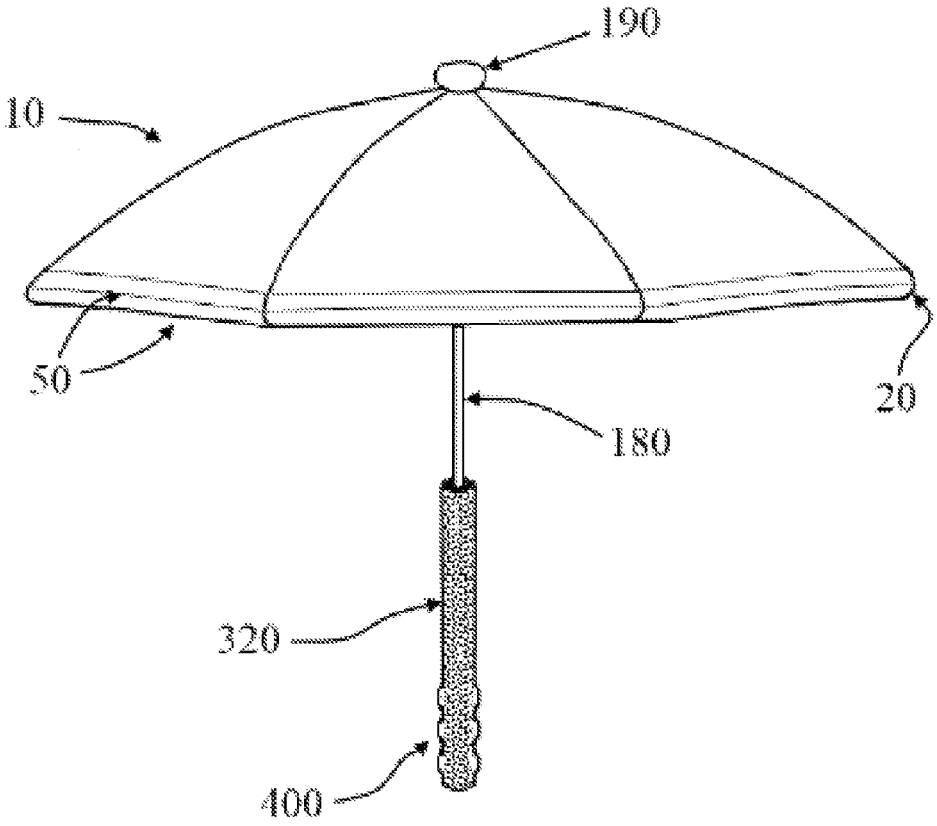
FIG. 1 is a perspective view of the present embodiment.
Figure 2:
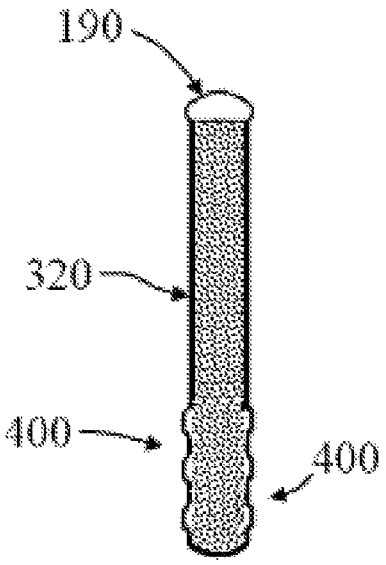
FIG. 2 shows the present embodiment of the invention fully retracted prior to implementation for service. In this configuration the moisture mitigation vessel encompasses complete double canopy, medially expanding frame, stick and other cooperating elements. At the top of moisture mitigation vessel, the knob is visible immediately above said vessel's portal. Hand grips are seen at the lower portion of the moisture mitigation vessel.

At onset of a precipitation event, or for use in another capacity such as a shield against excessive sunlight, deployment of the invention's present embodiment is accomplished in the following Moisture mitigation vessel 320 is held by one hand while the other grasps knob 190, as shown in FIG. 2, attached atop stick 180. Separating forces are then applied with both hands as knob 190 is pulled, thereby urging stick 180, complete double canopy 10, medially expanding frame 90, and cooperating elements to withdraw through portal 330 of moisture mitigation vessel 320.

Figure 3:
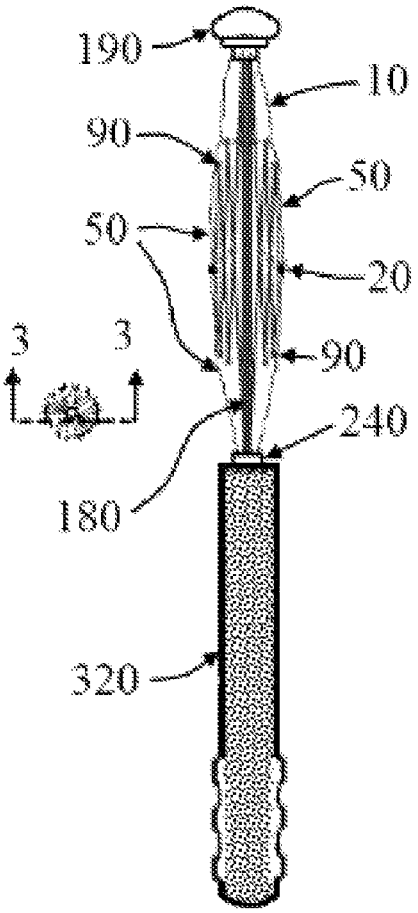
FIG. 3 shows a partially sectioned view of the embodiment's full double canopy, medially expanding frame, frame distal shields, knob, and stick while withdrawn from the moisture mitigation vessel, and not extended to their deployed configurations.
Figure 10:
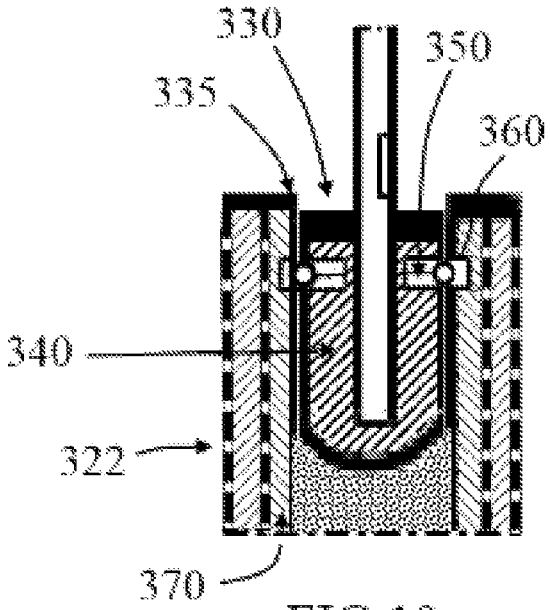
FIG. 10 is an enlarged sectional view of upper portion of the moisture mitigation vessel and cooperating elements.
Figure 11:
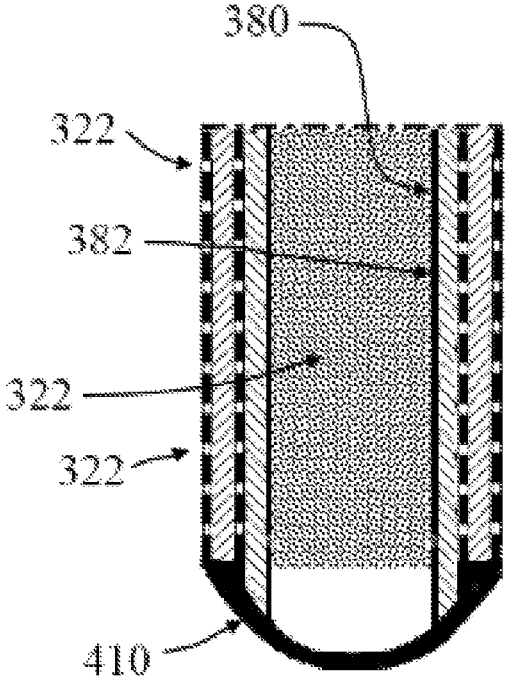
FIG. 11 is an enlarged sectional view of lower portion of the moisture mitigation vessel.

Upon attaining full extent of this withdrawal, as seen in FIG. 10, conventional stick lock collimation knob element 350 automatically engages stick lock vessel element 360, thereby providing means for securing stick collimation knob 340, stick 180 and cooperating elements in their respective vertically deployed configurations relative to moisture mitigation vessel 320. In the present embodiment, this operation is accomplished in a conventional manner, for example by engagement means between stick lock knob element 350 mounted on collimation knob 340 cooperating with stick lock vessel element 360 that in this embodiment takes the form of circular groove extending around and within upper interior wall of moisture mitigation vessel 320. Said stick lock elements when engaged are situated beneath collimation knob retention element 335. FIG. 3 shows stick 180 and cooperating elements fully withdrawn from moisture mitigation vessel 320.

Figure 4:
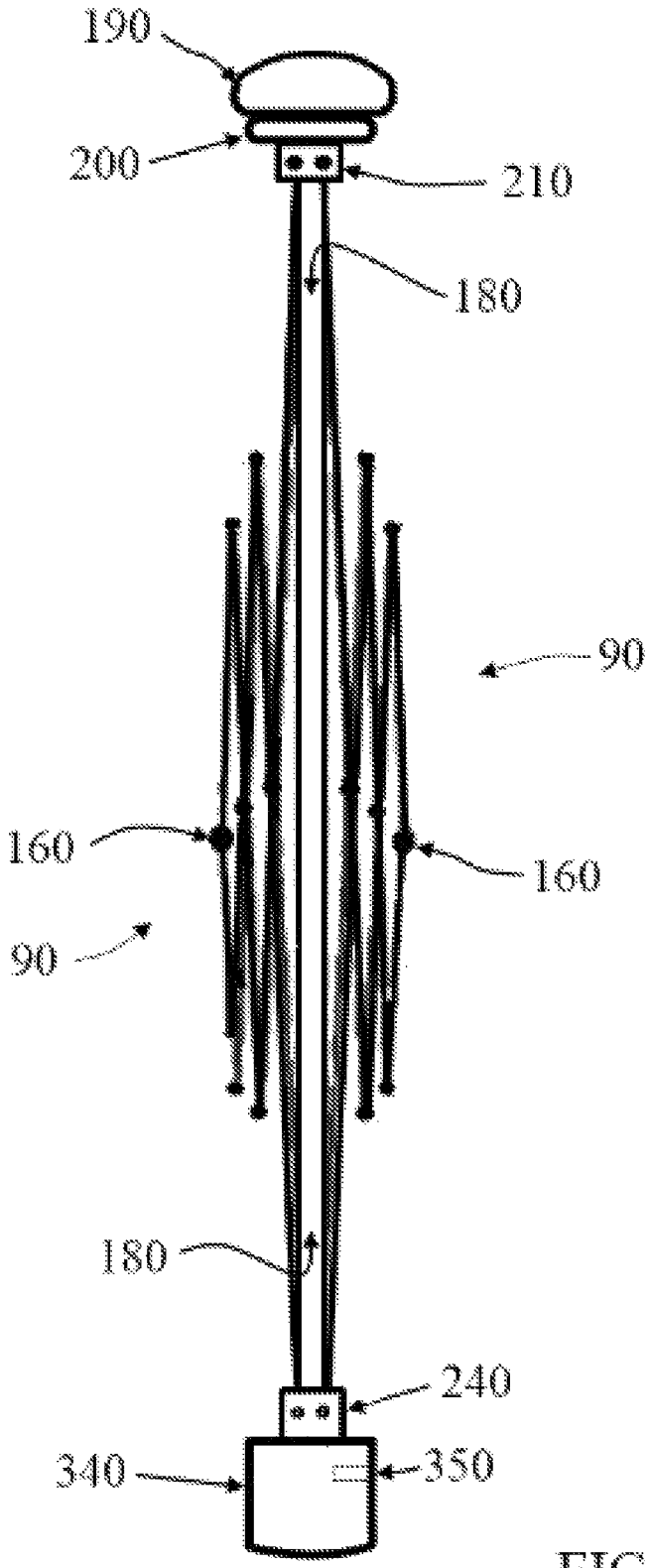
FIG. 4 is an enlarged sectional view of frame elements retracted adjacent to the umbrella stick while extended above the embodiment's moisture mitigation vessel.

FIG. 4 is an enlarged view showing a pair of linkage elements in medially expanding frame 90 at positions substantially proximate to opposite sides of stick 180. Frame distal shields 160 at frame links E 140 and F 150 are indicated.

After stick 180 is secured in its fully extended position relative to moisture mitigation vessel 320, knob 190 is released and force is applied to runner release element 290 thereby freeing runner 240 so it may be urged upward to its fully deployed position high on umbrella stick 180. At that deployed location, runner 240 is secured in place by means of automatic activation of conventional upper runner lock 280. By means of these actions the following effects are additionally accomplished.

Figure 5:
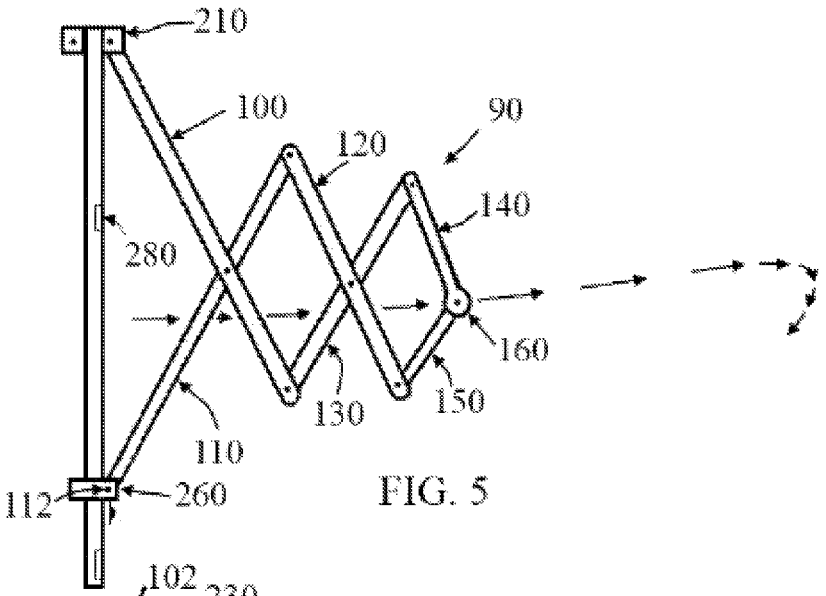
FIG. 5 shows elements in a semi-extended configuration with curvilinear trace lines indicating frame distal shield's direction of movement from retracted to deployed locations relative to the stick.

FIG. 5 shows enlarged views of linkage elements in medially expanding frame 90 partially and subsequently in FIG. 6 fully deployed, as said frame 90 transports complete double canopy 10 in an akimbo manner outward to the embodiment's fully extended configuration. The outer circumference of canopy distal periphery 20 of complete double canopy 10 is supported by frame distal shields 160 that function as distal termini of medially expanding frame 90. By means of pleats 50, complete double canopy 10 is capable of expanding from its retracted extent when vertically situated between runner 240 and notch 210. Notch 210 contains conventional notch to link A attachment joint 230, providing means for pivotal connection with frame elements designated link A 100. In addition, notch 210 contains attachment means for fixed connections with upper canopy segment 30 via notch to upper canopy segment attachment element 220.

Runner 240, capable of sliding in a vertical fashion along stick 180 and cooperating with conventional upper runner lock 280 and conventional lower runner lock 300, contains runner to link B attachment joint 260 providing means for pivotal connection with frame elements designated link B 110. Additionally, said runner 240 contains attachment means for providing fixed connections with lower canopy segment 40 via runner to lower canopy segment attachment element 70.

Figure 6:
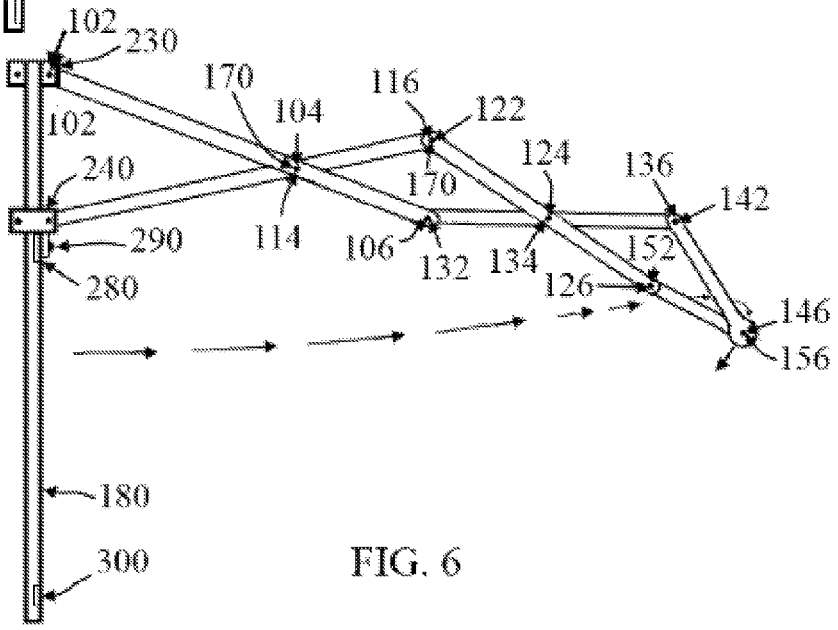
FIG. 6 is a view of elements in their fully deployed configuration.

Curved line arrows shown in FIG. 5 and FIG. 6 indicate the path followed by center of frame distal shield 160 during expansion and retraction operations of this embodiment. Distal periphery 20 of complete double canopy 10, when fully deployed adjacent to middle of curved outer surface of frame distal shield 160, is on a plane substantially lower than the fully deployed elevation of runner 330 along stick 180. As a result, the deployed complete double canopy 10 presents a substantially downwardly concave profile.

When the present embodiment is fully deployed, horizontal distance between stick 180 and canopy distal periphery 20 is 20 inches (50.8 cm.), equal to 32 relative length units such as those used below to indicate dimensions of links. When complete double canopy 10 and medially expanding frame 90 are retracted adjacent to stick 180, vertical separation between notch 210 and runner 240 is 15 inches (38.1 cm.) or 25 relative length units.

Figure 8:
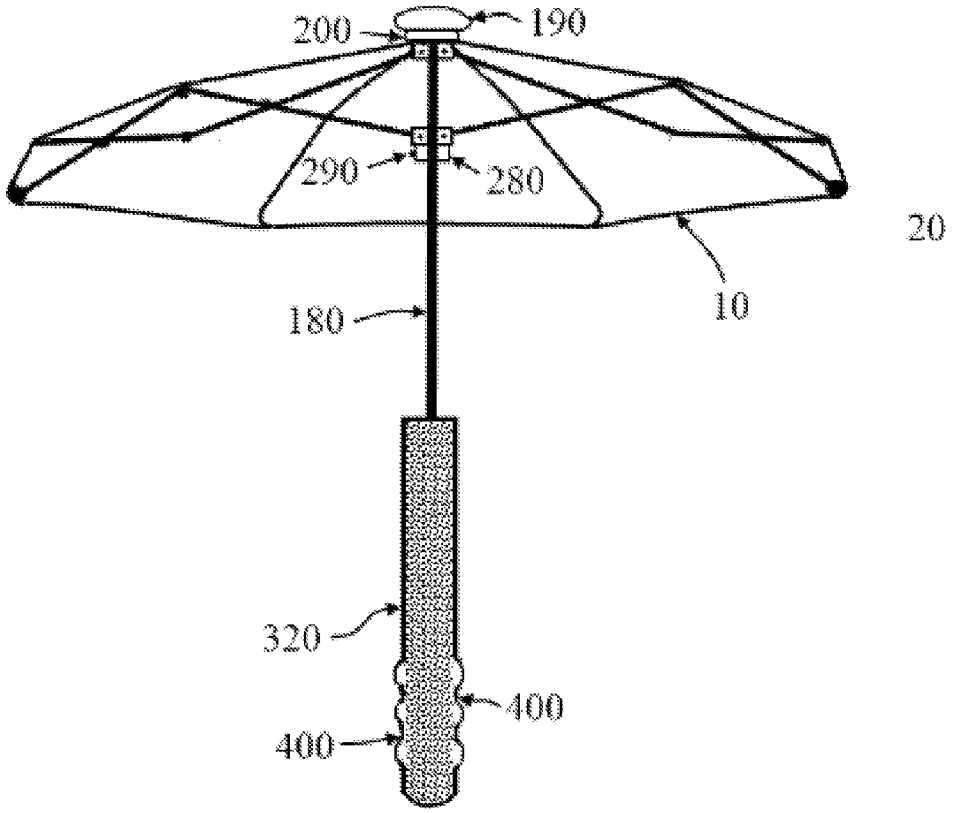
FIG. 8 is an elevation view showing a pair of frame elements fully deployed within complete double canopy.
Figure 9:
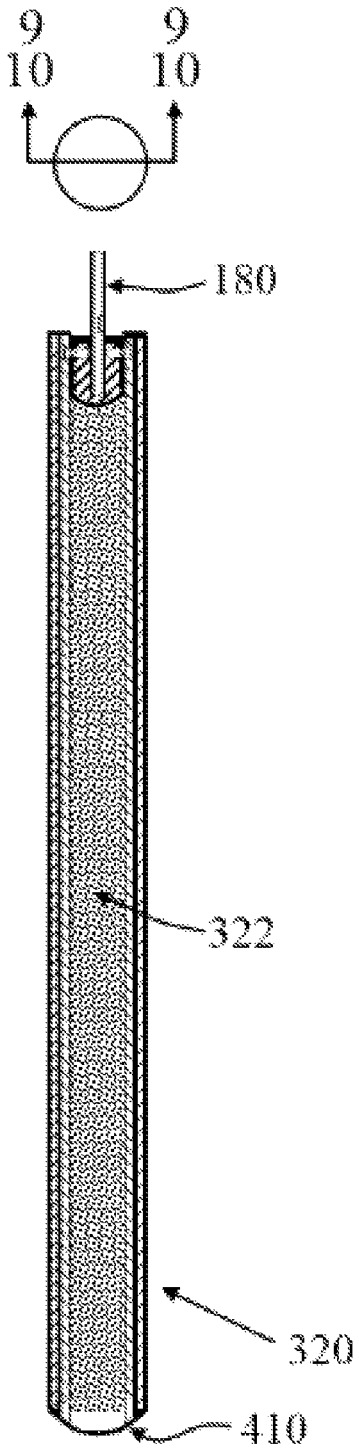
FIG. 9 is a sectional view of the interior of the embodiment's moisture mitigation vessel and cooperating elements.

FIG. 8 is a partial section drawing showing the deployed complete double canopy 10, two linkage components of medially expanding frame 90 at opposite sides of stick 180; and moisture mitigation vessel 410.

Figure 7A:
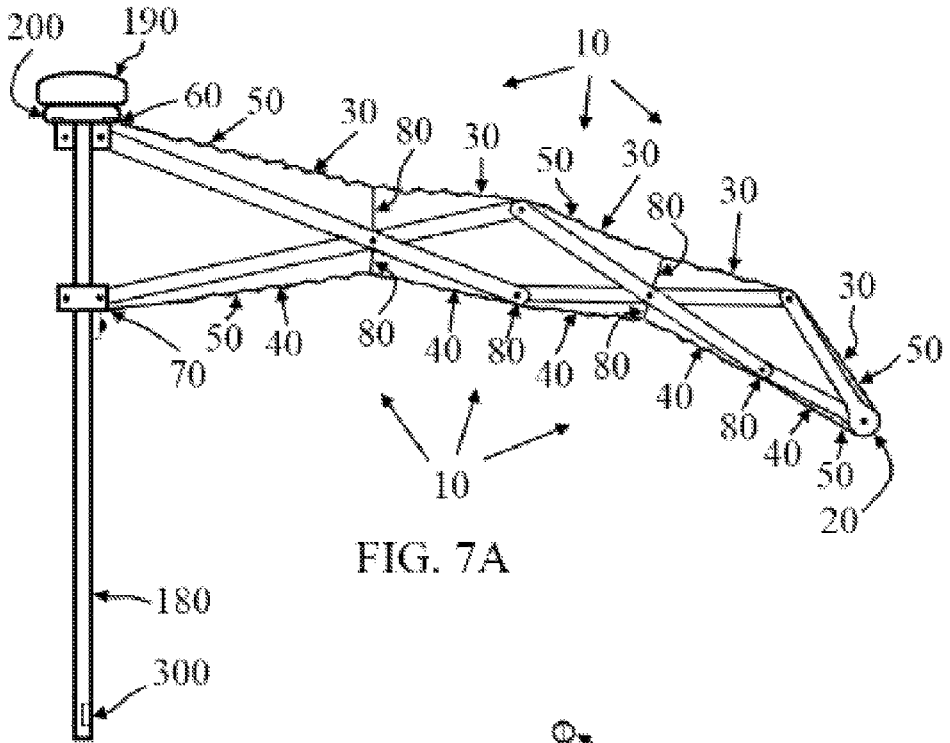
FIG. 7A shows complete double canopy and medially expanding frame elements of the present embodiment fully deployed.
Figure 7B:
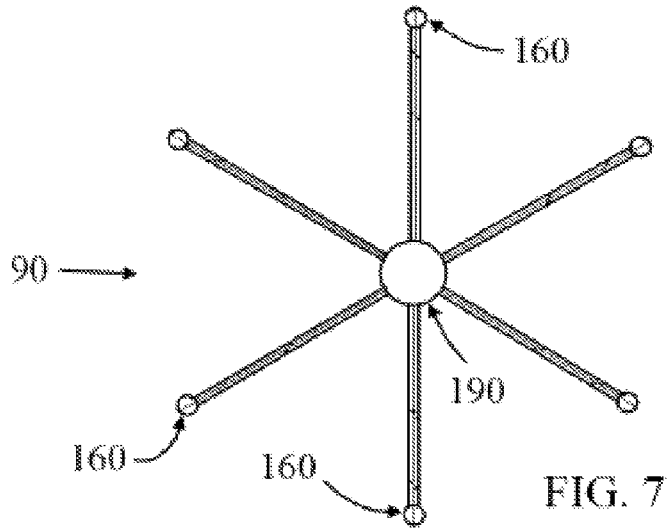
FIG. 7B is a top view of the six linkages comprising the medially expanding frame.

As may be seen in FIG. 7A, the present embodiment's construction provides means for the substantial separation between upper and lower segments 30, 40 of complete double canopy 10 as each segment extends across, encompasses, and is attached by conventional canopy to frame attachment elements 80, to the embodiment's medially expanding frame 90. This embodiment consequently provides enhanced stabilization means for supporting and maintaining integrity of the present embodiment's entire canopy and frame assembly. This reinforcement of the outermost annulus of the embodiment's covering assembly comprising complete double canopy 10, with pleats 50 and medially expanding frame 90 is the part where wind gusts can exert their greatest damaging upward torque and the potential for compromising structural integrity of an umbrella frame is greatest. Conventional double canopy umbrella constructions taught in prior art such as those referenced above generally lack such extensive bracing because of their lack of substantial vertical separation between their upper and lower canopy components, across the complete radial extent of the combined canopy and frame structure from stick to their most distal elements.

As an additional improvement, the substantial curved profile of the embodiment's frame termini provided by frame distal shields 160 gives means for improved safety from puncture wounds thereby helping to alleviate well-known dangers inherent with essentially pointed conventional umbrella rib tips.

Retraction

When retraction of the present embodiment is desired, grip grooves 400 at the lower end of moisture mitigation vessel 320 are again grasped in one hand while the other hand pushes runner release element 290, thereby freeing runner 240 from upper runner lock 280. These elements of locking engagement and release, as well as similar elements also associated with said runner 240, are conventional in nature. Runner 240 is then urged downward along stick 180 to its retracted position where said it is secured in place by automatic engagement with lower runner lock 300. Simultaneously, medially expanding frame 90 contracts and thereby provides means to urge complete double canopy 10, with pleats 50 to its retracted configuration substantially proximate to stick 180.

In the concluding phase of the embodiment's complete retraction, one hand maintains its hold on grip grooves 400 while the other hand grasps knob 190. As sufficient downward urging force is subsequently applied to knob 190, separation automatically occurs between stick lock knob element 350 and stick lock vessel element 360 thereby allowing stick 180 and its attached cooperating elements including complete double canopy 10 with pleats and medially expanding frame 90 to be urged down into moisture mitigation vessel 320. Friction between conventional seal 200 and portal 330 wall of moisture mitigation vessel 320 provides sufficient resistance to securely retain retracted elements within said vessel 320.

In the present embodiment components are composed, to the greatest extent possible given current availability of materials, material having low coefficients of electrical conductivity thereby providing means for enhanced safety. Overall dimensions of embodiments are fundamentally predicated by the desired extent of coverage. Pleats 50 and material composition of the present embodiment's complete double canopy 10 provide capability for substantial variations in overall size and specific increased overhead coverage area. These features, in addition to the invention's dripless performance when retracted, and frame distal shields 160, provide significant improvements in order to compete in the marketplace with pop-out and mini umbrellas.

Although the complete double canopy 10 with pleats, medially expanding frame 90 with frame distal shields 160, moisture mitigation vessel 320 wicking material 370, wicking material retainer 380 comprise the essence of the present embodiment of this invention, disclosed elements function in cooperation with a plurality of conventional components known in prior art of umbrella construction to form the present embodiment of the invention. Given the invention's detailed specification, its manner of fabrication and assembly would be obvious to one skilled in the practice of umbrella construction.

Complete Double Canopy 10, with Pleats 50

The present invention's complete double canopy 10 with pleats is composed of materials whose essence and configuration provide means to allow it to expand and contract as urged between desired retracted and deployed extents. Selection of material used to construct said canopy elements is discretionary, contingent on the current state of the art in material composition and capability. Canopy related factors, as well as considerations for other components of the present invention, include availability of material, intended adaptive use, anticipated production costs, and projected market conditions. Relevant factors are evaluated and taken into account during development phases prior to manufacture.

The complete double canopy 10 with pleats of the present embodiment is composed of water resistant material having capability to expand and contract by a significant factor facilitated by pleating. Upper and lower canopy segments are sufficiently capacious so as to substantially encompass said medially expanding frame 90.

Compositions considered for incorporation in the complete double canopy 10 of alternate embodiments may be of material having substantial innate capacity for extendibility. Material selected for construction of complete double canopy 10 has capability to conform by attachment means in a substantially congruent manner to the outer configuration of linkage elements comprising medially expanding frame 90 as said frame is urged alternatively between retracted and deployed configurations.

Expandability of the embodiment's canopy surface allows extension of said complete double canopy 10 to its full operational coverage. The individual size, number, and distribution of pleats 50 in the present embodiment are factors in the determination of the functional extent of canopy expansion between retracted and deployed configurations. Due to their construction, pleats 50 inherently have certain folding memory capability. Manufacture of the embodiment's complete double canopy 10 includes incorporation of material innately or as a result of post-production treatment having a significantly high resistance to water absorption.

When retracted over contracted medially expanding frame 90 in a manner substantially adjacent to the umbrella stick 180, the present embodiment's complete double canopy 10 assumes the form of a pleated double ended three dimensional envelope. The complete double canopy's upper and lower centers are respectively attached to the umbrella's notch 210 and runner 240. When adjacent to stick 180, retracted and stowed within moisture mitigation vessel 320, and subsequently after having been extracted but still remaining proximate to stick 190, prior to fully deployed extension to its in-service configuration, complete double canopy 10 of the present invention maintains the doubly tapered configuration having the generalized shape of two corrugated cones medially joined at their widest circumferences as seen in FIG. 3.

Benefiting from this doubly tapered configuration described above, the present embodiment of the invention provides a closely gathered emergent upper end of both canopy 10 and medially expanding frame 90 relative to portal 330 of the embodiment's moisture mitigation vessel 320.

Likewise, and significantly different from examples seen in prior art, the lower end of the invention's frame and cover structure is directly connected to umbrella runner 240 and therefore at all times is substantially proximate to stick 180 as seen in FIG. 3 and FIG. 7A. This improvement, wherein both upper and lower umbrella frame elements remain proximate to stick 180, provides means for facilitating passage the cooperating complete double canopy 10 as during alternate circumstances leaves and then after providing service, subsequently re-enters moisture mitigation vessel 320.

In this invention the doubly tapered means of angle of approach during both extraction and return of complete double canopy 10 and medially expanding frame 90 elements relative to portal 420 of moisture mitigation vessel 410 provides means to reduce frictional forces between their surfaces by providing a relatively small angle of mutual presentation.

The present invention provides improvements that eliminate the awkward approach of frame and canopy structures as they exit or re-enter stick mounted umbrella containers taught in prior art, such as several referenced above. Frame and canopy constructions in those examples approximate the conical shape of a badminton shuttle cock, with umbrella frame tips substantially separated from the device's stick unless tethered with a tie strap or confined by a tip cup when folded and prior to emergence from or re-entry relative to their associated storage container.

Cooperation between the present embodiment's complete double canopy 10 and medially expanding frame 90 also provides enhanced umbrella resilience that serves to reduce tendency of frame linkage elements to twist around their major horizontal axes extending radially out from umbrella stick 180. In addition, the triangular bracing provided by lower canopy segment 40

It is emphasized, that due to the present invention's comprehensive envelopment of medially expanding frame 90 by complete double canopy 10, means for substantially augmenting structural integrity of frame 90 is provided as a result of enhanced vertically triangular bracing of frame elements. This improvement is especially useful when umbrella frame elements are buffeted by potentially damaging wind gusts and increased tension is applied to, and resisted by, the lower canopy segment 40 of complete double canopy 10. This resistive capability provided by means of lower canopy segment 40, inherent in its substantially complete separation from upper canopy segment 30, exceeds capability inherent in conventional canopy and frame elements when subjected to strong upwardly directed wind forces.

Medially Expanding Frame

FIG. 3, FIG. 4, FIG. 5, FIG. 6, and FIG. 7A and FIG. 7B show medially expanding frame 90 of the present embodiment constructed in a manner that allows it to encourage expansion of cooperating complete double canopy 10 with pleats to deploy radially in an akimbo manner from locations immediately adjacent to the umbrella stick 180. Prior to said expansion, distal frame elements represented by centers of frame distal shields 160 are located substantially equidistant between the embodiment's notch 210 and the lower secured location of retracted runner 240.

Serving in the manner of protective bumpers, frame distal shields 160 are enlarged, curved termini of both link E 140 and link F 150 providing means for distributing contact forces at sections of canopy distal periphery 20 covering said shields 160 adjacent to distal pivot points of links E 140 and F 150. Due to their relatively wide profiles said frame distal shields 160 provide means for reducing potential for distal ends of said medially expanding frame 90 to cause puncture wounds to umbrella users or bystanders, a problem substantially exacerbated when conventional umbrellas become airborne, potentially causing eye damage or other bodily injury.

The present invention's medially expanding frame 90 enables concentrated deployment urging forces to be applied at the middle of the double ended cover envelope, in other words at the circumferential region where upper canopy segment 30 and lower canopy segment 40 of the complete double canopy 10 with pleats 10 is co-joined along canopy distal periphery 20. In this manner the frame's construction maximizes deployment forces applied along this circumference thereby providing means for enhancing an umbrella user's ability to urge and expand upper and lower cover elements 30, 60 of the complete double canopy 10 as they move from their retracted to fully deployed sites relative to said stick 190.

As was noted in the detailed description of the embodiment's complete double canopy 10, conventional umbrella constructions taught in prior art involving a storage container generally have rib tips that splay outward from the associated stick as said tips approach the container's opening during retraction operation. The present invention provides means for improved structure and organization of canopy and frame elements to alleviate that issue.

The present embodiment of the invention includes medially expanding frame 90 consisting of six individual sets of linkages, with each of these sets containing of six articulated diagonal crossing members designated as links A to F (100 to 150). When the present embodiment is viewed from above, the six linkages of medially expanding frame 90 are arrayed in a circular pattern radiating from a central vertical axis coincidental with umbrella stick 180.

Said diagonal crossing members of each of the six sets are herein individually identified as link A 100, link B 110, link C 120, link D 130, link E 140, and link F 150 each with specified relative dimensions. These 36 elements with cooperating frame pivot elements 170 substantially comprise the embodiment's medially expanding frame 90. Individual links are mutually attached by means of said frame pivot links 170 in a manner allowing rotational freedom relative to adjacent cooperating linkage elements thereby providing means for the assembled structure to function as a mechanical linkage of the type commonly known as a lazy tong.

Each of the six interior link A 100 elements is rotationally attached to the cooperating notch 210 by means of a link A to notch joint 230 and each lower interior link B 110 is attached to runner 240 by means of link B to runner joint 260. The two distally situated frame elements designated link E 140 and link F 150 are not medially attached to each other, but do have a mutual connection near their distal ends by means of a single frame pivot element 170. Additionally, the enlarged distal ends of links E 140 and links F 150 each form rounded frame distal shields 160 that provide means for presenting a substantially curved distal terminus to each of the six linkage frames rather than essentially pointed frame tips seen in prior art. This addition allows complete double canopy 10 to maintain a distal periphery 20 comprising a substantially curved vertical cross-sectional profile across an array of planes oriented perpendicular to said canopy's overall horizontal circumference. Specific attachment locations for rotational connections between corresponding frame diagonal links 100-150 are indicated in FIG. 5 and FIG. 6 of drawing 4.

Relative lengths of elongated frame linkage elements and distances between locations where frame pivot elements 170 allow rotational cooperative connections between individual links are indicated below for the example of this specific embodiment. Said elements are attached to associated cover with conventional canopy to frame fasteners 80. Said links are configured with respect to their number, orientation, composition, and dimensions of their elements sufficient to provide means for facilitating desirable cooperation during deployment and retraction phases of said umbrella's frame and its complete double canopy 10 with pleats. Co-joined pivot points of link E and link F frame elements distal to stick 190 are constrained by means of their dimensions to follow the curvilinear path illustrated in FIG. 5 and FIG. 6 of sheet 4.

The six individual linkage assemblies in the preferred embodiment's medially expanding frame 90 each consists of three interconnected pairs of links and cooperating parts. In FIG. 5 and FIG. 6, link A 100 and link B 110 of the interior linkage pair are shown attached respectively to notch 210 and runner 240. Link C 120 and link D 130 are attached respectively at their interior ends to the distal ends of link A 110 and link B 100. Distal ends of link C 120 and link D 130 are attached to interior ends of link E 150 and link F 140 respectively.

Relative dimensions indicated below specify that complete double canopy 10 with pleats of the present embodiment will deploy from its retracted configuration proximate to stick 180 in an akimbo manner as upward urging force is applied to runner 240. During this operation distal pivot points E 146 of link E 140 and distal pivot point 156 of link F 150 in each linkage set comprising medially expanding frame 90 traverse a curvilinear trajectory shown in both FIG. 5 and FIG. 6.

The following are approximate relative lengths of elongated frame linkage members of the present embodiment, comprising relative dimensions of pivoting point locations of link pivot attachments. Absolute dimensions of each link are predicated by overall dimensions of an embodiment as well as linkage material composition. Lengths of links must be greater than separations between interior and distal pivot points, and link widths must exceed diameters of holes made at each pivot point location in order to accommodate frame picot elements.

Link A 100 has separation between its interior pivot point A 102 and distal pivot point A 106 of 18.57 relative units and a distance from said interior pivot point A 102 to its medial pivot point A 104 of 12.25 units. For link B 110, corresponding measurements are 17.53 units and 11.27 units respectively. Link A 100 and link B 110 are mutually attached via frame pivot element 170 at their respective medial pivot points.

In the middle pair of linkages, link C 120 has separation between its interior pivot point C 122 and distal pivot point C 126 of 12.19 relative units, and a distance from said interior pivot point C 122 to its medial pivot point C 124 of 6.75 units. Corresponding measurements for link D 130 are 11.32 and 5.88 units respectively. At their interior pivot sites, link C 120 is attached to distal pivot point B 116 of link B 110 by means of a frame pivot element 170. Link D 130 is similarly attached to the distal pivot point 106 of link A 100. Another frame pivot element 170 connects link C 120 to link D 130 at said medial pivot points.

The outermost pair of links relative to stick 180 in each of the six linkages comprising medially expanding frame 90 consists of link E 140 and link F 150. Distance between interior pivot point E 142 of link E 140 and the distal pivot point E 146 is 6.08 units. Corresponding separation of interior and distal pivot points of link F 150 is 4.80 units.

Interior pivot point E 142 of link E 140 is pivotally attached to distal pivot point D 136 and the interior pivot point F 152 is connected to distal pivot point C 126 of link C 120 by means of frame pivot element 170.

Distal pivot point E 146 of Link E 140 is attached to the corresponding distal pivot site of link F 150 at by means of another frame pivot element 170. At this location of common rotational connection, the configuration of frame distal shield 160 provides means for the outermost ends of both link E 140 and link F 150 of medially expanding frame 90 to present substantially rounded rather than pointed distal termini. This manner of construction provides curved safety means at distal termini of the medially expanding frame 90, thereby reducing potential for injuries concomitant with traditional pointed or sharply angled umbrella frame rib endings.

It is again noted that the presently disclosed invention does not contain singular elongated distal rib elements extending substantially beyond distal conjoined links of the frame structure. The present embodiment therefore is significantly different from prior art in this regard, and in its use of relatively large rounded termini for its distal links. Both features differ substantially from conventional lazy tong type umbrella frames in which attached elongated ribs terminate in narrow points supporting a canopy's periphery.

Attributes such as absolute dimensions of components, conventional cross sectional profiles of frame linkage elements, and the manner of mutual attachment between frame and cooperating elements are left to the discretion of one skilled in the art of umbrella construction as being appropriate to a particular version at time of manufacture, examples being products similar to the present embodiment, or application to a "golf" sized or a "patio" style umbrellas.

Moisture Mitigation Vessel

The manner of canopy deployment and retraction of the present invention described in detail above provides means for improved and useful compact storage of its complete double canopy 10 with pleats and medially expanding frame 90. It additionally alleviates adverse effects consequent from having a moist umbrella cover retracted in a container lacking effective means for encouraging evaporation of the enclosed moisture.

Sheet 7 shows three cross-sectional views of moisture mitigation vessel 320, with its wicking material retainer 380 having the form of a perforated cylinder, providing means for maintaining wicking material 370 in a functional position immediately adjacent to the interior wall surface of moisture mitigation vessel 320. After retracted umbrella elements including complete double canopy 10 with pleats, medially expanding frame, and cooperating elements are secured within moisture mitigation vessel 320, said vessel's construction facilitates passage of moisture from the newly encompassed components to exit through a plurality of apertures in wall of said wicking retainer 380 into wicking material 370. The present embodiment's wicking material 370 comprises microfiber based fabric providing means for moisture transport. As moisture is absorbed it is then transported toward the plurality of apertures in wall of moisture mitigation vessel 320, then outward via said apertures 390 to the embodiment's ambient environment.

Amounts of wicking material required, and precise dimensionality of its emplacement, are contingent on factors best known at time of manufacture. Such factors include absorbency specificities of canopy material, its ability to shed moisture, compositional specifications of available wicking material, and the ratio of a particular wicking material's absorbency to the maximum amount of moisture anticipated to be carried into moisture mitigation vessel 320 by said canopy 10, frame 90, and cooperating elements. Wicking retainer 380 contains a plurality of apertures, with sufficient minimum separation between the outside edges of each opening so as to insure structural integrity of said liner 380.

Moisture mitigation vessel 320 is sufficiently rigid to support cooperating elements as deployed. The wall of said vessel is constructed in a manner so as to be also capable of serving as foundation for the invention's grip grooves 400.

In order to ensure firmly supported articulation between stick 180 and moisture mitigation vessel 320, stick collimation knob 340 is attached to the lower part of stick 180. Knob 340 thereby provides means for collimating and stabilizing stick 180 during deployment, use, and retraction operations. It provides means for supporting stick 180 as it is vertically centered along the longitudinal axis of the moisture mitigation vessel 320. Conventional stick lock 350 cooperates with said stick collimation knob 340 to secure said knob 340, stick, 180, medially expanding frame 90, complete double cover 10 with pleats, and cooperating elements, in position during times when said stick 180 is fully extended. Stick lock release element 360 is automatically activated in a conventional manner during retraction operations allowing said stick collimation knob 340 and cooperating stick 180 mounted elements to be urged and thereby withdrawn into moisture mitigation vessel 320.

Alternate Embodiments

In an alternate embodiment, said complete double canopy with pleats 10 and medially expanding frame 100 provide covering service without a cooperating moisture mitigation vessel 320.

Modifications

While the preferred embodiment and alternate embodiment of the invention have been described above, it will be recognized and understood that various modifications can be made in the invention, and the associated claims are intended to cover all such modifications which may fall within the spirit and scope of the invention. For example, service provided by the invention might be in the form of a hand held umbrella, a large "garden" type umbrella, or as a component of a tent or other manner of providing protective coverage.

In another example, elastic elements attached to said complete double canopy 10 may provide means for urging its retraction while also allowing expansion due to urging forces acting on it by cooperating frame elements. The complete double canopy may be constructed using material innately capable of expansion and contraction.

Material composition of canopy elements including upper 30 and lower canopy segments 40 may be opaque, translucent, or transparent, provide solar protection via broad band wavelength filtration, or may incorporate prisms for effecting rainbow colors. Suitable material for use in said canopy 10 includes specialized paper products manufactured by melding plastic between layers of paper. Articles may be suspended within upper and lower segments of the complete double canopy 20. These objects may comprise mobile items and lights. Light sources, light emitting diode (LED) elements for example, may be mounted within the compass of complete double canopy 10, thereby providing means for illumination. Mechanisms used to secure stick 180 and medially expanding frame 90 in positions relative to other elements of the present invention may vary, including such conventional devices as bayonet type interlocks, and varied methods of securing element to element connection, articulation, and fastening such as those that may gleaned from the conventional art.

Ramifications and Scope

The words "horizontal", "vertical", "up", "down", "in", "out", "top", "bottom", upper, lower, "interior", "exterior", "distal" and similar expressions are to be interpreted as relative to the embodiments discussed and cooperating components of the invention and are not intended to be otherwise limiting. Embodiments described herein are included for example only. Additional variations of the claimed invention's concepts will be obvious to those skilled in the art, such as adaptation or inclusion of known alternative devices and materials.

Although the description above contains much specificity, this should not be construed as limiting the scope of the invention but as merely providing illustrations of some of the present embodiments of this invention. In addition, medially expanding frame 90, complete double canopy 10, and cooperating elements may be composed of alternate materials. Elements of the medially expanding frame 90 may be brought to their deployed and retracted positions along alternate trajectories, rather than that specified in the present example. Dimensions of frame elements, their number, and arrangements within its total composition, as well as variations of lengths and connection positions of links, may be specified by one skilled in the art according to desired usage factors. Such factors include ability to resist, in cooperation with elements of complete double canopy 10, structural deformations caused by various anticipated levels of wind intensity. Specified dimensions of all other elements can vary; stick 180 may have a conventional telescoping type embodiment, moisture mitigation vessel 320 may or may not be present. When present said vessel 180 can have other longitudinal shapes, such as oval, conical, hemispheric, crafted in a freely creative form, or utilitarian shape such as that which may serve as a hand grip, and said vessel may have other cross-sectional shapes such as circular, oval, trapezoidal, triangular, etc., moisture mitigation vessel 320 as well as other suitable surfaces such as the upper and lower surfaces of the complete double canopy 10 may be used for flattened or three dimensional, such as bas-relief, decorative or commercial representations including text, and or illustrations; the medially expanding frame 90 may have varied numbers of individual elements, dimensions and manifestations.

Elements connecting linkage elements of the frame may have alternate dimensions, shapes, and compositions, complete double canopy 10 may, in additional embodiments, have other compositions, dimensions, manners of expansion and contraction other than pleats, such as that provided by inherently expandable materials, stated connections for attaching various elements of the invention to cooperating elements can be replaced by other types of connection which enable said elements to be appropriately constrained, or when necessary have means to rotate or translate effectively relative to cooperating elements. Alternate devices may be used for attachment, and connecting various elements. Although our disclosed system functions with a variety of components seen in the prior art, it does not necessarily require all of these. Each part indicated above may also find a useful application in other types of structure differing from those described.

The present invention has been illustrated as embodied in an umbrella but it is not limited to that embodiment, because various omissions, and changes in the shapes and specifics of the illustrated invention, and its operation, can be made without altering the fundamental character of the invention. For example elements of the present invention may be used to comprise components of a tent system, or be incorporated with an umbrella having a storage container and canopeum. The description of the present invention has been made for purposes of revealing a particularly useful embodiment. It is not intended to limit the invention to only the disclosed form. The scope of the invention should be determined by the appended claims and their legal equivalents, rather than by the examples given.

We claim:

1. An improved umbrella system comprising, canopy, stick, notch, and runner, wherein improvements comprise: a medially expanding frame, said frame providing means for extending the circumference of the canopy from a retracted position substantially proximate to, and medially situated adjacent to, an umbrella stick, expanding in a curvilinear substantially radial manner to a fully deployed configuration wherein said canopy, supported by said medially expanding frame, assumes a downwardly concave configuration, distal ends of the medially expanding frame, when fully extended, being situated on a plane perpendicular to the umbrella stick that is substantially lower than the plane perpendicular to said stick located at a vertical elevation substantially equal to that of the umbrella runner when said runner is fixed at its fully deployed upper location along said stick, said medially expanding frame comprising a plurality of linkage sets arrayed radially around a central axis coincidental with the major axis of said umbrella stick, said linkage sets comprising a plurality of individual links in the form of a lazy-tong, providing means to extend said distal ends of the frame to fully deployed positions relative to said stick, each link in said linkages being ordered in a progression of paired sets, each set having an upper and a lower member, following a sequence of said sets progressing from the set substantially adjacent to said stick then, set by set, progressing to link sets located further removed from the stick toward the most distal set of links in any given linkage, relative lengths between interior and distal ends of said links, tallied in said orderly sequence of upper to lower from the set more proximate to said stick, to an adjacent less proximate set, and further progressing to the most distal set of links, the relative length between interior and distal pivot points of said links progressively decreasing in magnitude, in a similar manner, relative distances between the interior and medial pivot points of the links in said sequence also decreasing continuously, each linkage set not having any extended individual element projecting substantially beyond conjoined distal ends of its outmost pair of links, said distal pair of links having distal ends with curved surfaces whose radii are substantially greater than the maximum transverse dimension of elongated frame elements, thereby providing safety means.

2. The improved umbrella system of claim 1, further comprising: a complete double canopy substantially consisting of an upper and a lower canopy segment, each having a plurality of pleats and material composition, providing means for facilitating substantial increase of effective surface covering extent when said complete double canopy is urged between a retracted and a deployed configuration, upper and lower segments of said canopy being attached to said medially expanding frame while also having a configuration, when fully deployed, substantially separated from the other segment except at their mutual periphery, thereby cooperating with and providing means to substantially encompass elements comprising said medially expanding frame, and also providing means to enhance structural integrity of said medially expanding frame, said complete double canopy comprising material having substantial resistance to absorption of moisture.

3. The improved umbrella system of claim 2, further comprising: a moisture mitigation vessel, said vessel providing means for encompassing said complete double canopy, said medially expanding frame and cooperating conventional elements, said moisture mitigation vessel also having wicking material with moisture absorbing ability and permeability thereby providing means for encouraging absorption and transport of moisture from said encompassed elements toward a plurality of apertures in the moisture mitigation vessel's wall, said moisture mitigation vessel having means to structurally cooperate with conventional umbrella support elements, attachment elements, and securing elements including said stick.

4. An improved umbrella system with conventional elements comprising stick, runner, notch, wherein improvements comprise: a complete double canopy substantially consisting of an upper and a lower canopy segment, each segment with means, comprising pleats and or intrinsic compositional ability, to expand in functional surface extent when said complete double canopy urged between retracted and deployed configurations, upper and lower segments of said canopy being substantially separated from the other except at their mutual periphery at all times when said canopy is at its fully deployed location relative to the umbrella stick, thereby cooperating with and providing means to substantially encompass, as well as providing means for structural reinforcement of elements comprising a cooperating frame, said complete double canopy comprising material of composition having substantial resistance to absorption of moisture, said improved umbrella system additionally comprising a medially expanding frame providing means for extending the circumference of the umbrella canopy from its retracted location substantially proximate to, and medially situated adjacent to, an umbrella stick, expanding in a substantially curvilinear and radial manner to a fully deployed configuration wherein said complete double canopy, supported by said medially expanding frame, assumes a downwardly concave configuration, said distal elements of the medially expanding frame, when fully extended, being situated on a plane perpendicular to the umbrella stick that is substantially lower than another plane perpendicular to said stick that is located at an elevation substantially equal to that of the umbrella runner when the runner is fixed at its fully deployed upper location along said stick, said medially expanding frame comprising a plurality of linkage sets arrayed radially around a central axis coincidental with the major axis of said umbrella stick, said linkage sets comprising a plurality of individual links in the form of a lazy-tong, providing means to extent the distal end of its outermost pair of links to a fully deployed position relative to said stick, each link in said linkages being ordered in a progression of paired sets, each set having an upper and a lower member, following a sequence of said sets progressing from the set substantially adjacent to said stick then, set by set, progressing to link sets located further removed from the stick toward the most distal set of links in any given linkage, relative lengths between interior and distal ends of said links, tallied in said orderly sequence of upper to lower from the set more proximate to said stick, to an adjacent less proximate set, and further progressing to the most distal set of links, the relative length between interior and distal pivot points of said links progressively decreasing in magnitude, in a similar manner, relative distances between the interior and medial pivot points of the links in said sequence also decreasing continuously, with the exception being the most distal pair of links which are pivotally attached to each other only at their distal ends, each linkage set not having an extended elongated element projecting substantially beyond conjoined distal ends of its outmost pair of links, distal termini of said frame elements having curved surfaces whose radii of curvature substantially exceed the maximum cross-sectional dimension of elongated elements comprising said medially expanding frame thereby providing safety means, said improved umbrella system further comprising a moisture mitigation vessel, said vessel providing means for encompassing the complete double canopy, medially expanding frame and cooperating conventional elements, and providing means for encouraging absorption and transport of residual moisture from said umbrella elements toward a plurality of openings in the moisture mitigation vessel's wall that provide means to vent outward to the invention's ambient environment, said moisture mitigation vessel having means to structurally cooperate with conventional umbrella support elements, attachment elements, and securing elements including the umbrella stick, and hand grasp elements included in the moisture mitigation vessel's configuration.

5. The improved umbrella system of claim 4, further comprising: each link in said linkages being ordered in a progression of three paired sets, each set having an upper and a lower member, following a sequence of said sets progressing from the set substantially adjacent to said stick then, set by set, progressing to link sets located further removed from the stick toward the most distal set of links in any given linkage, relative lengths between interior and distal ends of said links, tallied in said orderly sequence of upper to lower from the set more proximate to said stick, to an adjacent less proximate set, and further progressing to the most distal set of links, the relative length between interior and distal pivot points of said links progressively decreasing in magnitude according to the following sequence of relative values: 18.57, 17.53, 12.19, 11.32, 6.08, 4.80, in a similar manner, relative distances between the interior and medial pivot points of the links in the following sequence, 12.25, 11.27, 6.75, 5.88, it is noted the distal pair of links in this form of linkage are distally, but not medially, attached to each other.

* * * * *